US005775630A

United States Patent [19]

Högberg et al.

[11] Patent Number: 5,775,630

[45] Date of Patent: Jul. 7, 1998

[54] ROLL STAND

[75] Inventors: Hans Högberg; Stefan Bäck, both of Åmål, Sweden

[73] Assignee: Amal Aktiebolag, Amal, Sweden

[21] Appl. No.: 605,062

[22] PCT Filed: Sep. 16, 1994

[86] PCT No.: PCT/SE94/00862

§ 371 Date: Mar. 5, 1996

§ 102(e) Date: Mar. 5, 1996

[87] PCT Pub. No.: WO95/08503

PCT Pub. Date: Mar. 30, 1995

[30] Foreign Application Priority Data

Sep. 20, 1993 [SE] Sweden ..... 9303055

[51] Int. Cl.[6] ..... B65H 19/16

[52] U.S. Cl. ..... 242/554.6; 242/555.7

[58] Field of Search ..... 242/554.3, 554.5, 242/554.6, 555.6, 555.7; 192/4 R

[56] References Cited

U.S. PATENT DOCUMENTS

| | | | |
|---|---|---|---|
| 2,249,669 | 5/1941 | Robertson | 242/58 |
| 2,834,808 | 5/1958 | Bradshaw | 242/555.7 X |
| 3,103,320 | 9/1963 | Huck | 242/554.6 X |
| 3,381,912 | 5/1968 | Huck | 242/554.3 |
| 3,825,201 | 7/1974 | Osta | 242/554.3 |
| 3,944,151 | 3/1976 | Lee et al. | 242/555.6 |
| 4,165,842 | 8/1979 | Mengel | 242/554.6 X |
| 4,194,701 | 3/1980 | Andreasson | 242/554.5 |
| 4,543,152 | 9/1985 | Nozaka | 242/554.5 X |
| 4,715,922 | 12/1987 | Hayashi et al. | 242/554.6 X |

FOREIGN PATENT DOCUMENTS

| | | | |
|---|---|---|---|
| 31 28 551 A1 | 2/1983 | Germany . | |
| 39 05 401 A1 | 10/1989 | Germany . | |
| 698481 | 10/1953 | United Kingdom | 242/554.5 |
| 2 033 347 | 5/1980 | United Kingdom . | |
| 1 575 390 | 9/1980 | United Kingdom . | |
| 4019267 | 9/1994 | WIPO | 242/554.5 |

*Primary Examiner*—Daniel P. Stodola
*Assistant Examiner*—William A. Rivera
*Attorney, Agent, or Firm*—Nikaido, Marmelstein, Murray & Oram LLP

[57] ABSTRACT

The invention relates to a roll stand (1') comprising a frame (3') with a roll-holding device (71) for two unwinding stations (A', B'), which frame (3') comprises means (101, 102, 103) for joining, in a roll-changing operation, a material web, which is unwound from a roll (12, 12a) provided with a rotating spindle (171, 181), to a leading end, provided with adhesive, of a material web from another roll (12, 12a) which is similarly provided with a rotating spindle (171, 181), as well as means (108, 109) for cutting off the first-mentioned web and a mechanism for braking the spindles. The invention is further characterized by means (117, 118, 172, 173, 182, 183, 197) for, on the one hand, transferring the rotary moment from the roll spindles (171, 181) to a braking mechanism (115), comprising a free-wheel mechanism (157, 195) arranged to connect the braking mechanism (115) to the roll spindle (171, 181) which is momentarily rotating at the highest speed and on the other hand, at the start of a roll-change operation, transferring an accelerating moment from an acceleration unit (116) to the roll spindles (171, 181), which acceleration unit comprises a free-wheel mechanism (165, 166) arranged to connect the acceleration unit to the roll spindle (171, 181) which is momentarily rotating at the lowest speed.

9 Claims, 5 Drawing Sheets

A
171
174
175
170
173
176
129
172
70
179
189
118
182
186
180
185
184
B
181
183
1'
115
159
156
157
10
2
197
196
198
195
181
169a
117
6'
169
3
4
167
168
165
166
163
116
161

ROLL STAND

TECHNICAL FIELD

The present invention relates to a roll stand comprising a frame with a roll-holding device for two unwinding stations, which frame comprises means for joining, in a roll-changing operation, a material web, which is unwound from a roll provided with a rotating spindle, to a leading end, provided with adhesive tapes or glue strands, of a material web from another roll which is similarly provided with a rotating spindle, as well as means for cutting off the first-mentioned web and a mechanism for braking the spindles.

PRIOR ART

In production machines which operate with material in a running web from a roll, e.g. a rotary printing press, the unreeling roll is arranged in a roll stand, e.g. on a shaft, and provided with a braking device on the shaft or on the periphery of the roll, regulated such that the web tension between the roll and the production machine can be controlled. For high-speed production machines, automatic, roll-changing roll stands are used in order to increase the productivity of the machine and reduce material wastage.

Roll stands of this kind are provided with at least two roll-fixing arrangements, space being available for both an unreeling roll and at least one new roll. The automatically working roll stand is arranged such that when the unreeling roll starts to run out, the new roll is brought into rotation automatically or by push-button signal, driven by drive belts or drive pulleys abutting against its periphery. The leading end of the new roll is lightly fixed to underlying winding turns and prepared on the top side with a glue coating, double-sided adhesive tape or similar. In effecting the joint between the unreeling roll and the new roll, the paper webs are brought into mutual contact with the aid of a brush and/or a roller and, when the leading end of the new roll is stuck fast to the unreeling material web, a severing knife is brought into operation and slices through the web of the previously unreeling roll. The new roll is now joined to the paper web.

To enable the above-mentioned to work, an accurate synchronization is required between the speed of the running-off web and the peripheral speed of the new roll. This can be achieved, for example, with an electronic comparator system in such a way that the peripheral speed of the new roll is measured, which speed is compared with a corresponding signal from, for example, the main shaft of the production machine. By virtue of other automatic devices, the peripheral speed of the new roll has to be brought in line with that of the unreeling web.

In our patent GB 2 033 347 B, a compact roll stand is described having two roll fixtures in the form of two spindles seated on a rotatable frame. A roll is unwound in a front unwinding position until its diameter has reached a certain maximum measure. The unwinding roll has hereupon obtained a sufficiently small diameter to be accommodated in a rear unwinding position, whereupon the frame is consequently rotated by half a turn. The front unwinding position herein becomes vacant for the installation of a new roll. Prior to the web in the rear unwinding position being joined to the web of the new roll, the new roll is accelerated with the aid of a drive wheel acting against the periphery of the new roll until the respective web speeds coincide. The webs are hereupon joined, whereafter the web of the rear roll is severed with a knife designed for that purpose. The roll in the rear unwinding position is subsequently braked, as a rule, to a standstill. In the said roll stand there is a brake which constantly regulates the web tension such that no jolts occur in the web. The brake acts upon transmissions which transfer the braking effect to the spindles. A freewheel hub seated in each spindle allows the braking effect only to reach that of the spindles which is rotating the fastest.

BACKGROUND TO THE INVENTION

In new production machines of the above-specified type, there is now a desire to increase the web speed and increase the diameter of the roll sizes, whilst in all respects essentially maintaining the overall size of the roll stand. The increased roll sizes create spatial problems within the roll stand. The drive wheel acting for the acceleration of the roll cannot be accommodated. In addition to this, there are further drawbacks with the said drive wheel. The periphery of the roll is prepared with an adhesive, usually an adhesive tape or a glue strand, for adhesion to the web from the other roll in effecting the joint. It is not however possible to have an adhesive covering the entire width of the web, owing to the fact that the adhesive sticks to the drive wheel, whereupon the paper layer, too, sticks to the drive wheel. An adhesive covering the entire width of the web is needed however to make the joining operation more secure in purely general terms and especially if the changeover is to be executed at increased web speed. The drive wheel can additionally slip against the surface of the paper, whereupon the paper may suffer damage if it is thin, poor in quality or if the roll has been incorrectly handled during storage and/or transport, thereby inflicting cracks or other damage upon the outer turns of the web of the roll. With increasing web speed and increasing roll sizes, there is an increased risk of problems arising which result in production stoppages as a consequence of the action of the drive wheel upon the surface of the roll.

BRIEF ACCOUNT OF THE INVENTION

The object of the present invention is to provide a roll stand having a modified mechanism for acceleration and braking of the rolls which does not exhibit the above-mentioned drawbacks. The acceleration motor and brake of the roll stand herein act upon the respective centrally located spindles of the rolls with the aid of freewheel hubs, which conduct the accelerating or braking moment to the roll which is momentarily correct. The object is additionally to provide a roll stand having a low spatial requirement, which meets the future, more elevated demands with regard to roll size and web speed.

These and other objects of the invention can be achieved by virtue of the fact that the invention is characterized by that which is specified in the subsequent patent claims.

Further characteristics and aspects of the invention derive from the following description of a preferred embodiment.

BRIEF DESCRIPTION OF DRAWINGS

In the following description of a preferred embodiment, reference will be made to the appended drawings, in which.

DESCRIPTION OF A PREFERRED EMBODIMENT

Figure 1:
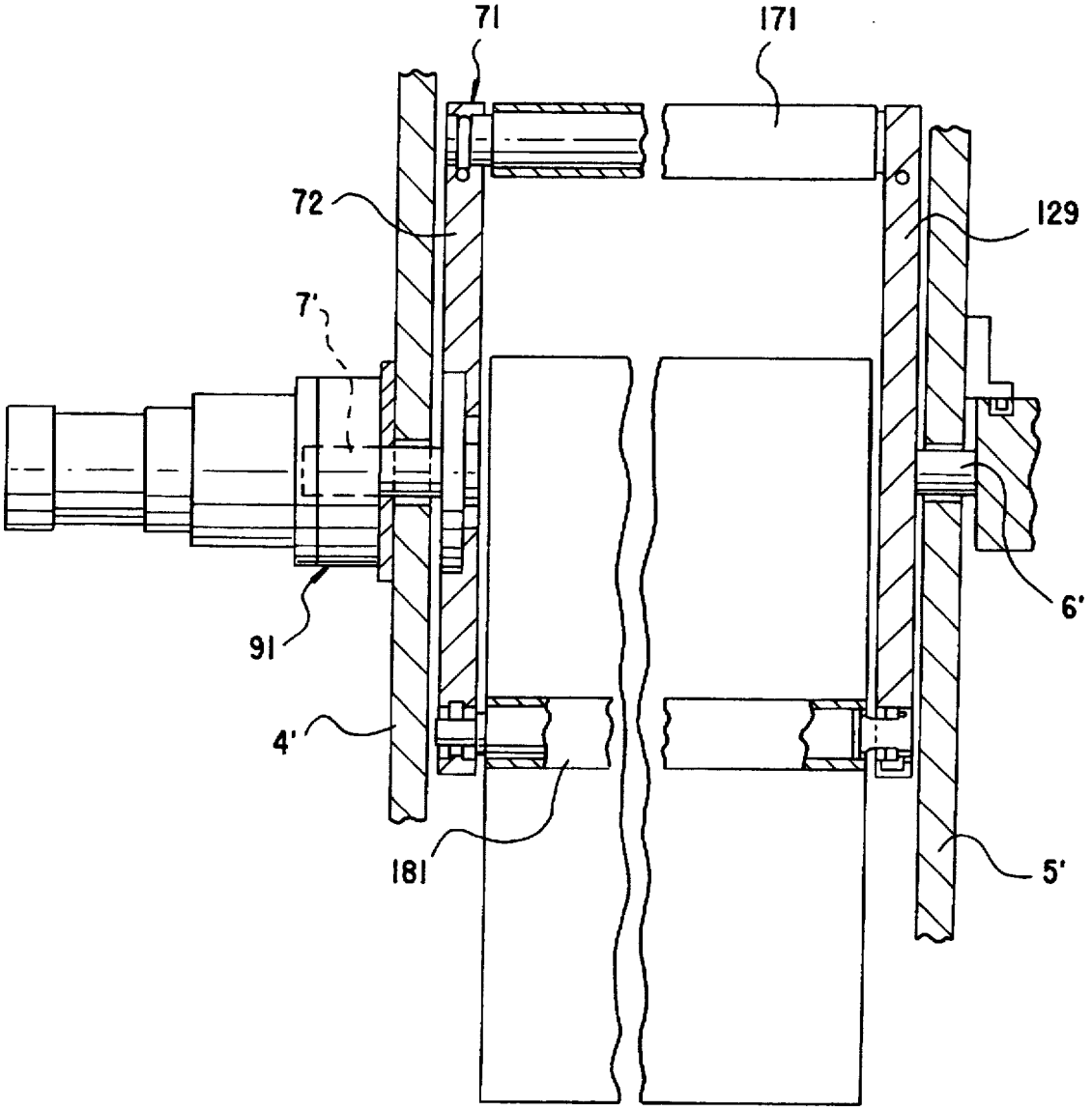
FIG. 1 shows a longitudinal view, partially in section, of the roll stand.
Figure 2:
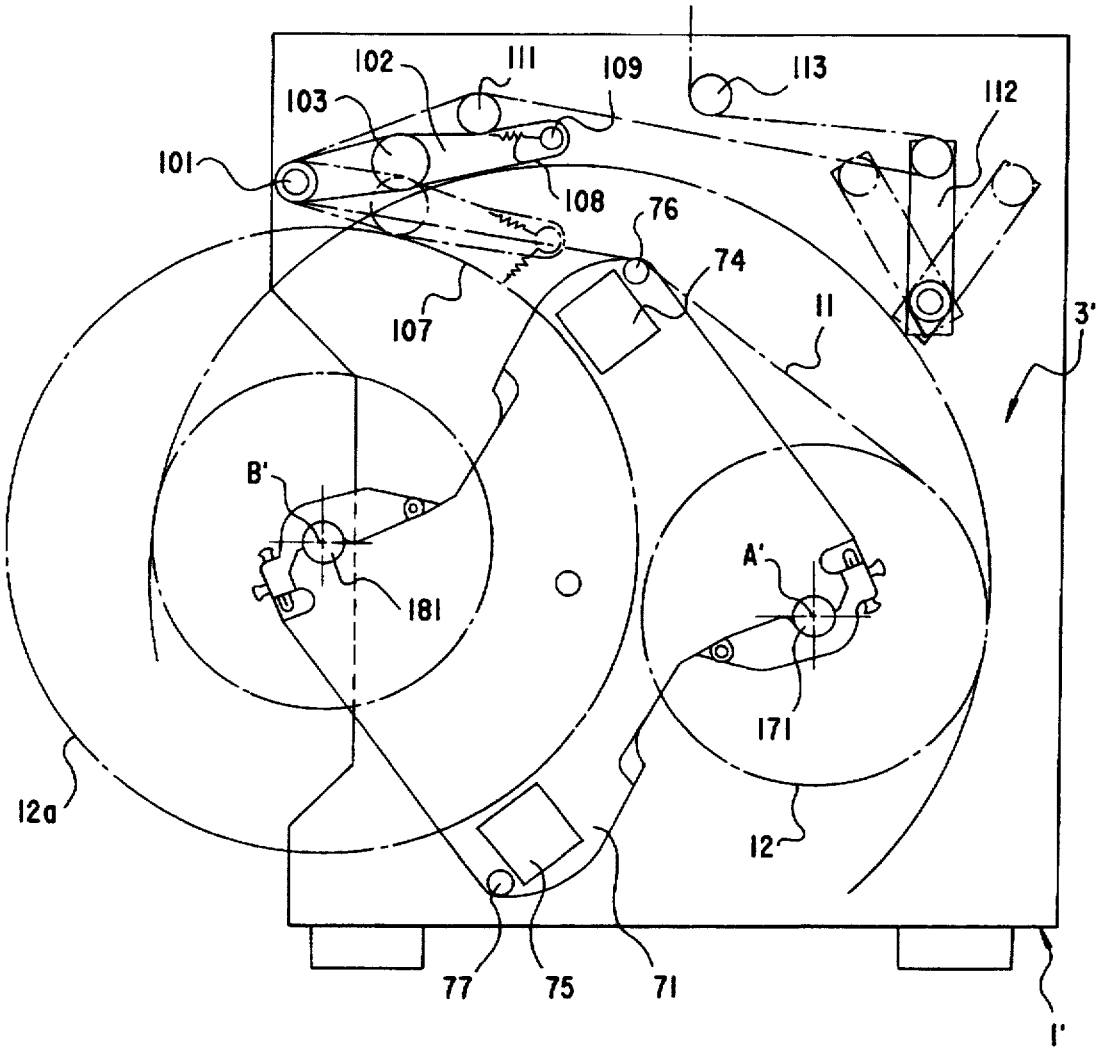
FIG. 2 shows a view from the side of the roll stand according to the invention.

According to FIGS. 1 and 2, the frame 3' of the roll stand 1' has two carriers 4', 5', which are provided with two supporting shafts 6', 7', with the aid of which a roll-holding device 71, comprising two unwinding stations A' and B', is rotatably connected. The roll-holding device 71 comprises two roll carriers 72, 129, which are coupled with two rods 74, 75 close to two guide rollers 76 and 77 which are each designed to direct the paper web from the respective unwinding station A' and B' via a press roller and guide rollers into the printing unit 2'. The roll-holding device 71 can be rotated with the aid of a motor 91 and gearing and mountings 70 (FIG. 3).

In each unwinding station A', B', a roll spindle 171 and 181 respectively can be inserted in order rotatably to connect the respective paper roll 12, 12*a*. Each of the roll spindles 171, 181 are driven, at their respective one ends, by a respective cog wheel 174, 184, which cog wheels are rotatably connected to a roll arm 129.

Figure 3:
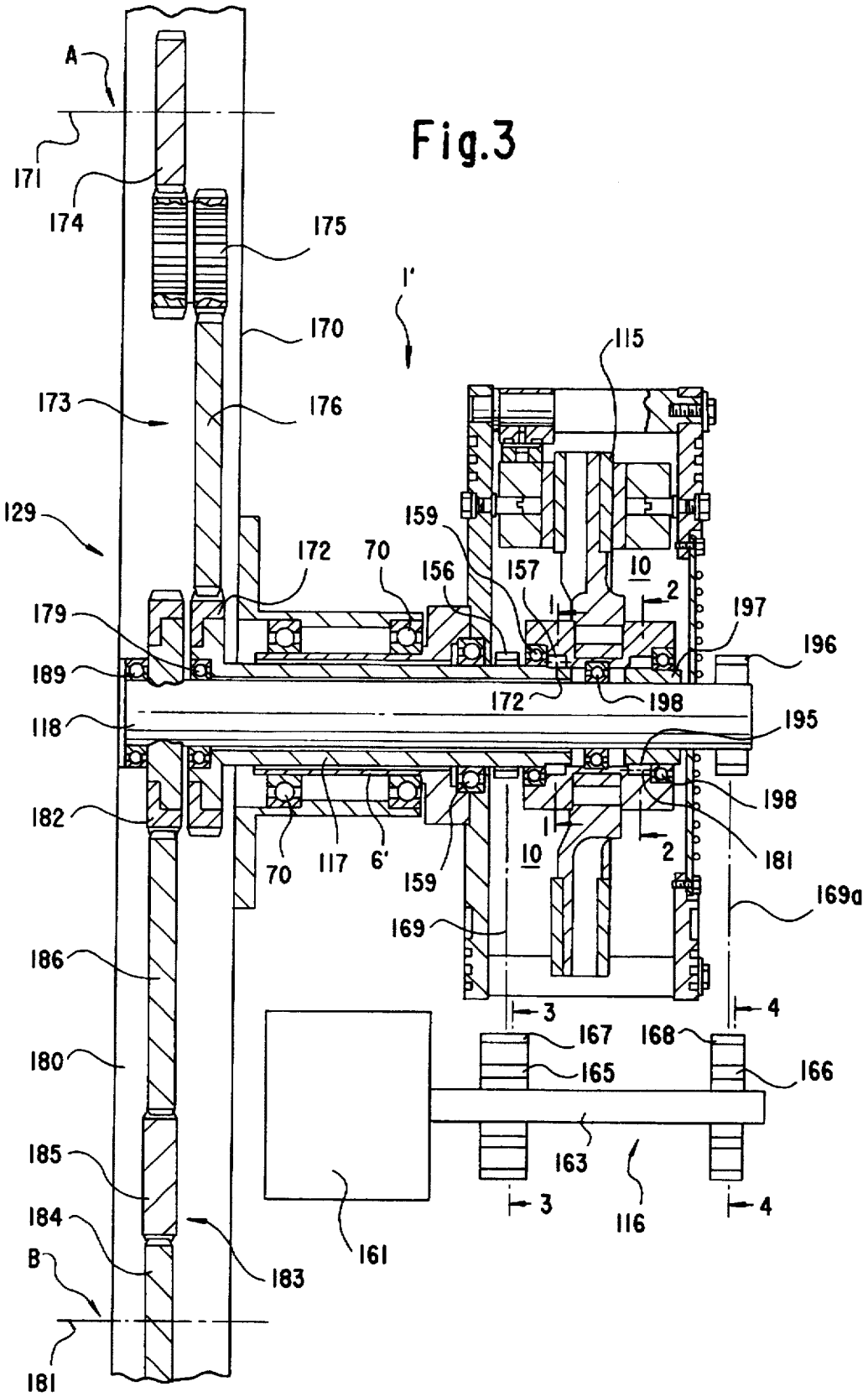
FIG. 3 shows a sectional view of the one roll arm, in which the action of the brake and acceleration motor upon the two spindles can be seen.

In FIG. 3, a braking device 115 and an acceleration device 116 are shown, which, together with two coaxially arranged, non-interlinked shafts 117, 118, constitute a roll centre 10. The shafts comprise a hollow shaft 117 and a core shaft 118. Perpendicular to the outer ends of the said shafts 117, 118 there are seated the roll arm 129, having two equal-length legs 170, 180, and two spindles 171, 181, which are rotatably connected at the ends of the legs 170, 180. The shafts 117, 118 pass through the supporting shaft 6' and each have, at their respective ends facing the roll arm 129, their central cog wheel 172, 182. The shafts 117, 118 are mounted in a number of ball bearings 179, 189. As each of the shafts 117, 118 rotate about their common centreline, the respective central cog wheel 172, 182 acts upon the respective spindle 171, 181 via a respective roll arm transmission 173, 183. The roll arm transmission comprises in each case three cog wheels 174, 175, 176 and 184, 185, 186 respectively, which transfer the effect from the central cog wheel 172 and 182 to the roll spindles 171 and 181 respectively and vice versa.

The inner ends of the shafts 117, 118 are each connected to the brake 115 via two freewheel hubs 157, 195. The freewheel hub 157 transfers braking moments from the brake 115 to the hollow shaft 117 and onward to the spindle 171 via the roll arm transmission 173 in the leg 170 of the roll arm 129. The freewheel hub 195 transfers braking moments from the brake 115 to a wedged hub ring 197 seated on the core shaft 118 and onward to the spindle 181 via the roll arm transmission 183 in the leg 180 of the roll arm 129. The freewheel hubs 157, 195 are arranged, when the brake 115 is actuated, to transfer braking moments to the spindle which is rotating the fastest.

Forming part of the roll centre 10 is an acceleration unit 116, comprising an acceleration motor 161, an acceleration shaft 163, two toothed belt pulleys 167, 168, two freewheel hubs 165, 166, of which one freewheel hub 165 is seated in the centre of the toothed belt pulley 167 on the acceleration shaft 163 and one freewheel hub 166 is seated in the centre of the toothed belt pulley 168 on the acceleration shaft 163. Two toothed belt pulleys 156, 196 are fixedly connected to the inner parts of the shafts 117, 118. Two toothed belts 169, 169*a* transfer rotary moments from the acceleration unit 116 via the freewheel hubs 165, 166 and the toothed belt pulleys 167, 168 to the shafts 117, 118, via the toothed belt pulleys 156 and 196 on the respective hollow shaft 117 and core shaft 118, and onward to the spindles 171, 181 via the respective roll arm transmissions 173, 183 in the respective legs 170, 180 of the roll arm. The freewheel hubs 165, 166 are arranged, upon acceleration, to transfer rotary moments to the spindle which is rotating the slowest.

According to one variant of the present embodiment, the freewheel hubs 165, 166 for acceleration of the spindles can also be placed in the centre of the toothed belt pulleys 156, 196 on the hollow shaft 117 and core shaft 118 respectively.

According to FIG. 2, there is seated above the unwinding station B', rotatably connected on a shaft 101, a lever 102 having a rotatably connected press roller 103. A piston-and-cylinder unit (not shown) can rotate the lever 102, in a known manner, from an upper, neutral position to a position in which the press roller 103 abuts against the periphery 107 of the roll 12*a* in the unwinding station B'. The roll stand comprises, also in a known manner, means for cutting the paper web 11 from the paper roll 12. These comprise a knife 108, which can be rotated about a centre of rotation 109 of the lever against the paper web, whereupon the knife passes through the paper web 11 and cuts this off with the aid of its edge. The roll stand additionally comprises a number of guide rollers 111, 113, brake members (not shown) for, at the same time as the knife 108 passes through the paper web 11, braking the roll 12 essentially to a standstill, and a pendulum roller 112 for steering and tensioning of the paper web.

The working of the roll stand can be described on the basis of FIG. 2, in which a roll 12 is in the unwinding station A' and is being unreeled and a new roll 12*a* has been fitted in the unwinding station B', which roll 12*a* has been prepared such that its leading end has been coated with adhesive tapes or glue strands which cover the entire width of the web and such that so-called "tabs" have been used to secure the leading end against the rest of the roll during the acceleration phase. The unwinding station A' is herewith unwound and the spindle 171 rotates, as do the roll arm transmission 173 and the hollow shaft 117, at the same time as braking moments from the brake 115 are transferred via the freewheel hub 157 for braking of the spindle 171 to the hollow shaft 117, so as to keep the web tensioned. The unwinding station B', the spindle 181 and the core shaft 118 are stationary.

Figure 4:
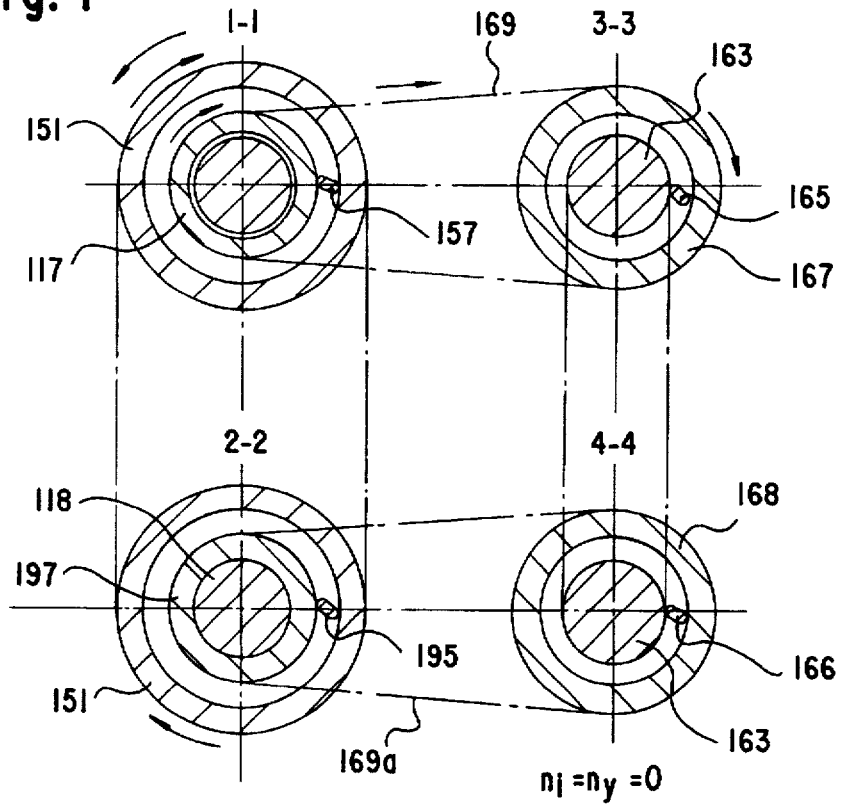
FIG. 4 shows in schematic representation the action of the freewheel hubs during the operating sequence when spindle 171 is unreeled and spindle 181 is stationary.

This instance has been illustrated schematically in FIG. 4, in which four sections from FIG. 3, the sections 1-1, 2-2, 3-3 and 4-4, have been compiled to illustrate how the moments are transferred. The section 1-1 shows the hollow shaft 117 during rotation, which hollow shaft acts upon the brake disc 151 via the freewheel hub 157 for braking of the spindle 171, which is engaged. Braking moments are herein transferred to the hollow shaft so as to keep the web tensioned. From the section 2-2 it can be seen that the brake disc rotates faster than the wedged hub ring 197 of the core shaft 118, which is stationary, for which reason the freewheel hub 195 for the brake for the spindle 181 slips. The section 3-3 illustrates the toothed belt pulley 167 (which rotates by virtue of the effect from the hollow shaft 117 via the toothed belt pulley 167 upon the hollow shaft and the toothed belt 169) and the acceleration shaft 163 in the middle, which is here stationary, for which reason the freewheel hub 165 for acceleration of the spindle 171 slips therebetween. In the section 4-4, the toothed belt pulley is stationary (owing to the fact that the core shaft 118, the toothed belt pulley 196 and the toothed belt 169*a* are stationary) at the same time as the acceleration shaft 163 is stationary, in which case no acceleration moment is transferred via the freewheel hub 166 for acceleration of the spindle 181.

Once the paper web 11, which passes over the guide roller 74, has been used up to such an extent that the diameter of the roll 12 has decreased to a certain set measure, the acceleration shaft 163 starts up as a result of the effect from the acceleration motor 161, which thus only comes to act upon the unwinding station B', in which the new roll 12*a* is seated, by virtue of the fact that the toothed belt pulley 168 (which is connected to the core shaft 118) is running more slowly than the toothed belt pulley 167 (which is connected to the hollow shaft, which continues to spin). The roll 12*a* has to be accelerated to the same peripheral speed as the roll 12, for which reason the roll 12*a*, due to its greater diameter, comes to acquire a considerably lower rotation speed than the roll 12 at the same peripheral speed and, by virtue of the fact that the acceleration unit 116 always acts upon that of the shafts 117 and 118 which runs the slowest, the roll 12 does not come to be acted upon by the acceleration unit 116.

Figure 5:
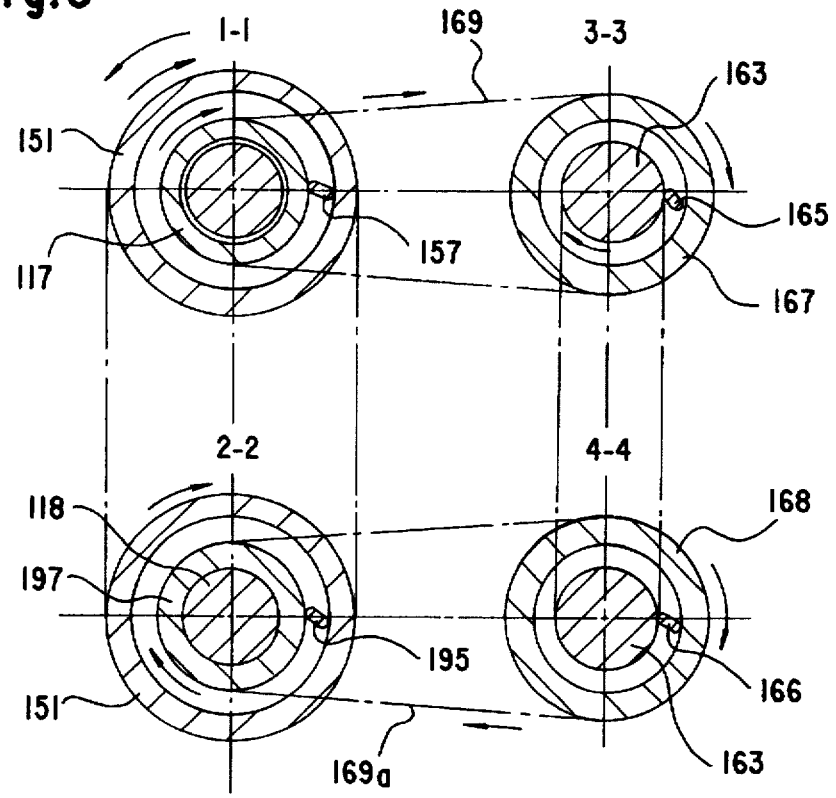
FIG. 5 shows in schematic representation the action of the freewheel hubs during the operating sequence when spindle 171 is unreeled and spindle 181 is accelerated.

This instance, too, has been illustrated schematically in FIG. 5 with the aid of the same sections as in FIG. 4. The section 1-1 shows, in the same way as in FIG. 4, the hollow shaft 117 during rotation, which acts upon the brake disc 151 via the freewheel hub 157 for braking of the spindle 171, which is engaged. Braking moments are herewith transferred to the hollow shaft in order to keep the web tensioned. From the section 2-2 it can be seen that the brake disc rotates faster than the wedged hub ring 197 of the core shaft 118, for which reason the freewheel hub 195 for braking of the spindle 181 slips. In the section 3-3 are shown the toothed belt pulley 167 (which rotates by virtue of the effect from the hollow shaft 117 via the toothed belt pulley 156 upon the hollow shaft and the toothed belt 169) and the acceleration shaft 163 in the middle, which here rotates more slowly than the hollow shaft 117, for which reason the freewheel hub 165 for acceleration of the spindle 171 slips therebetween. In the section 4-4, the acceleration shaft 163 rotates and an accelerating moment is transferred via the freewheel hub 166 for acceleration of the spindle 181 to the toothed belt pulley 168, the toothed belt 169*a*, the toothed belt pulley 197 and the core shaft 118, etc. to the roll 12*a*.

Once the roll 12*a* has accelerated to a rotation speed which gives the roll a peripheral speed essentially consistent with the peripheral speed of the small roll 12, the press roller 103 comes to drop down and abut against the unwinding web 11 by virtue of the effect from the piston-and-cylinder unit (not shown) and press the unwinding web 11 against the leading turn on the new roll 12*a*, whereupon the leading end of the roll 12*a* is glued together with the unreeling web 11 with the aid of the glue tapes or adhesive tapes on the leading end of the roll 12*a*. The knife 108 is hereupon rotated about its centre of rotation 109 and cuts off the web 11 from the roll 12. Simultaneously with this operation, the roll 12 is braked. At the same time, the acceleration unit 116 is also shut off. After this, the press roller 103 returns to its starting position.

Figure 6:
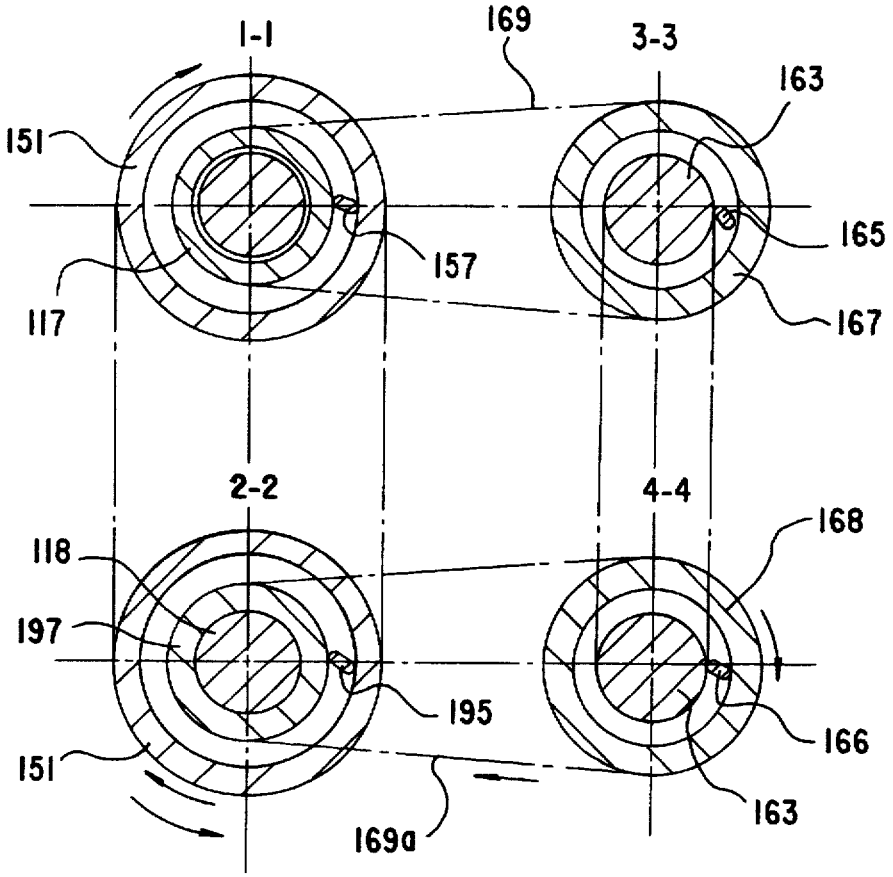
FIG. 6 shows in schematic representation the action of the freewheel hubs when the web has been changed over to spindle 181 and spindle 171 has been stopped.

In the above-mentioned sections 1-1, 2-2, 3-3 and 4-4, there herein occurs the following, as can be seen from FIG. 6. In section 1-1, the hollow shaft 117 is stationary, since the roll 12 in the unwinding station A' is stationary. At the same time the brake disc 151 rotates, which is now lying horizontal and brakes the core shaft 118. The freewheel hub 157 for braking of the spindle 171 in this case slips. The section 2-2 shows the core shaft 118 during rotation, which acts upon the brake disc 151 via the freewheel hub 195 for braking of the spindle 181, which is engaged. Braking moments are hereupon transferred to the wedged hub ring 197 of the core shaft 118, so as to keep the web tensioned. In the section 3-3, the toothed belt pulley 167 is stationary (owing to the fact that the hollow shaft 117, the toothed belt pulley 157 and the toothed belt 169 are stationary) at the same time as the acceleration shaft 163 is stationary, in which case no acceleration moment is transferred via the freewheel hub 165 for acceleration of the spindle 171. In the section 4-4 are shown the toothed belt pulley 168 (which rotates by virtue of the effect from the toothed belt pulley 196 upon the wedged hub ring 197 of the core shaft 118 and the toothed belt 169*a*) and the acceleration shaft 163 in the middle, which is here stationary, for which reason the freewheel hub 166 for acceleration of spindle 181 slips therebetween.

Once the diameter of the new roll 12*a* has decreased to a certain set value as a result of the unwinding of the web and the switching arm 102 has returned to its original position, the roll-holding device 71 is rotated clockwise by half a turn. The roll 12*a* hereupon assumes the position for the unwinding station A' and the roll 12 becomes available in the unwinding station B' for a change of roll.

According to this embodiment, the roll stand is equipped with a device which allows the paper web 11 to be able to be slightly displaced in the lateral direction to ensure that it passes through the printing unit 2' in the correct manner. The device is known from our above-mentioned patent GB 2 033 348 B and will not be more closely described here.

The use of the freewheel hubs 157 and 195 offers the advantage that there is no need to think about the connection and disconnection of any coupling to the braking device 115, since it is always the fastest rotating of the two spindles 171, 181 which takes control of the rotation of the brake disc 151. In the same way, the use of the freewheel hubs 165 and 166 offers the advantage that there is no need to think about any coupling to the acceleration unit 116, since it is always the slowest rotating of the two spindles 171, 181 which acquires the accelerating moment from the acceleration shaft.

By having the spindles, in the above-mentioned manner, act upon separate transmissions 170, 180 and shafts 117, 118, which are connected via freewheel hubs to a brake and an acceleration motor, acceleration as well as braking of the spindles 171, 181 can be directed from within the roll centre 10. This offers the advantages that, in effecting the joint, adhesive covering the entire width of the web can be used, that the contacting surface of the roll is not exposed to mechanical action during the acceleration and that rolls of the above-mentioned larger type are able to be accommodated in the roll stand without the roll stand consequently taking up greater floor space.

The procedure which is herein described for transferring acceleration and braking moments respectively to two separate rolls from just one driving device and just one brake can also be used in other embodiments, e.g. in roll stands having stationary roll positions, and arrangements in which the rolls are changed from the side. The transfer of power from the acceleration shaft 163 to the shafts 117, 118 can possibly also be executed with ropes, chains, V-belts and similar, which in this case act upon rope wheels, cog wheels, V-belt pulleys, etc.

The electrical control members forming part of the roll stand 1', for example limit switches and photoelectric cell equipment for automatically executing the various regulating operations, have not been shown in the drawing since they are known by the expert. The same applies to equipment for the safety of the work force.

The invention can be modified within the scope of the subsequent patent claims. For example, the brake unit 115, similarly to the acceleration unit 116, can be positioned such that it is laterally displaced relative to the coaxially arranged shafts 117 and 118 and can act by means of V-belts upon the transmissions which regulate the braking of the roll having the highest speed.

We claim:

1. Roll stand comprising:

a frame;

at least one supporting shaft mounted on said frame;

a roll-holding device on said at least one supporting shaft and having two unwinding stations, each unwinding station including a rotatably mounted roll spindle;

means mounted on said frame for joining a first material web during a roll-changing operation unwound from a roll provided on one rotating roll spindle to a leading end of a second material web from another roll mounted on the other rotating roll spindle, the leading end being provided with adhesive;

means for cutting off the first material web; and a rotational motion transmission connected to each of the roll spindles, said transmission including two coaxially arranged shafts running through said at one supporting shaft, roll arm transmissions connected between said two coaxially arranged shafts and said roll spindles, an acceleration unit arranged to drive said two coaxially arranged shafts, a braking unit arranged for braking the spindles, and means for transferring the rotary moment from the roll spindles to the braking unit, comprising a first free-wheel mechanism arranged to connect the braking unit to the one roll spindle which is momentarily rotating at a higher speed than the other roll spindle, and at the start of the roll-changing operation, for transferring an acceleration moment from the acceleration unit to the roll spindles, said transferring means further comprising a second free-wheel mechanism arranged to connect the acceleration unit to the one roll spindle which is momentarily rotating a lower speed than the other roll spindle.

2. Roll stand according to claim 1, wherein the roll-holding device comprises two roll carriers mounted on said at least one supporting shaft, two roll arms rotatably mounted on said carriers, said roll arm transmissions being seated in the one of the roll arms and said roll spindles being mounted between said roll arms.

3. Roll stand according to claim 1, wherein the braking unit and the acceleration unit are seated together on one of the two carriers.

4. Roll stand according to claim 1, wherein the acceleration unit includes an acceleration shaft laterally displaced relative to the two coaxially arranged shafts.

5. Roll stand according to claim 4, further comprising a non-gear drive mechanism for the transfer of power from the acceleration shaft to the two coaxially arranged shafts.

6. Roll stand according to claim 1, wherein the braking unit is coaxial with and in direct connection with the two coaxially arranged shafts.

7. Roll stand according to claim 1, further comprising a motor connected to said at least one supporting shaft wherein the roll-holding device, when the positions of the rolls are shifted, is arranged to be rotated by half a turn by said motor.

8. Roll stand according to claim 7, wherein the frame supports two carriers for the roll holding device and the braking unit and the acceleration unit are seated on one carrier and the motor for rotating the roll-holding device to shift the positions of the rolls is seated on the other carrier.

9. Roll stand according to claim 1, wherein the brake unit is laterally displaced relative to the two coaxially arranged shafts and includes a laterally displaced brake shaft and an associated non-gear drive mechanism arranged to act upon the first free-wheel mechanism.

* * * * *